US007144289B2

(12) United States Patent
Murasko et al.

(10) Patent No.: US 7,144,289 B2
(45) Date of Patent: Dec. 5, 2006

(54) METHOD OF FORMING AN ILLUMINATED DESIGN ON A SUBSTRATE

(75) Inventors: Matthew Murasko, Manhattan Beach, CA (US); Patrick J. Kinlen, Fenton, MO (US); Kenneth Kurtz, St. Louis, MO (US); Kevin Carroll, O'Fallon, MO (US); Michael B. Kiely, St. Louis, MO (US)

(73) Assignee: Lumimove, Inc., St. Louis, MO (US)

( * ) Notice: Subject to any disclaimer, the term of this patent is extended or adjusted under 35 U.S.C. 154(b) by 344 days.

(21) Appl. No.: 10/674,111

(22) Filed: Sep. 29, 2003

(65) Prior Publication Data

US 2004/0058615 A1 Mar. 25, 2004

Related U.S. Application Data

(60) Division of application No. 09/815,077, filed on Mar. 22, 2001, now Pat. No. 6,965,196, which is a continuation-in-part of application No. 09/548,560, filed on Apr. 13, 2000, now abandoned.

(51) Int. Cl.
*H05B 33/10* (2006.01)
*H05B 33/00* (2006.01)

(52) U.S. Cl. ..... 445/25; 445/24

(58) Field of Classification Search ..... 445/24, 445/25; 427/66

See application file for complete search history.

(56) References Cited

U.S. PATENT DOCUMENTS 1,163,637 A 12/1915 Dick
2,090,248 A 8/1937 Chakow (Continued)

FOREIGN PATENT DOCUMENTS

DE 3042159 6/1982

(Continued)

OTHER PUBLICATIONS

Partial Translation of Japanese Utility Model Application No. 63-115851 corresponding to Japanese Unexamined Utility Model Publication (Kokai) No. 2-36893.

(Continued)

*Primary Examiner*—Mariceli Santiago
(74) *Attorney, Agent, or Firm*—Nelson Mullin; Riley & Scarborough, LLP

(57) ABSTRACT

Signs including electroluminescent lamps are described. In accordance with one embodiment of the present invention a sign includes an electroluminescent lamp integrally formed therewith. The electroluminescent lamp is formed on the sign by using the sign as a substrate for the lamp and performing the steps of screen printing a rear electrode to a front surface of the sign, screen printing at least one dielectric layer over the rear electrode after screen printing the rear electrode to the sign, screen printing a phosphor layer over the dielectric layer to define a desired area of illumination that is smaller in area than the dielectric layer, screen printing a sealant layer over the remaining portion of the dielectric layer, screen printing a layer of indium tin oxide ink to the phosphor layer, screen printing an outlining electrode layer to the sign that outlines the rear electrode, screen printing a background layer onto the sign so that the background layer substantially surrounds the desired area of illumination, and applying a protective coat over the indium tin oxide ink and background layer. The rear electrode of each lamp is screen printed directly to the front surface of the sign, and the other layers of the EL lamp are screen printed over the rear electrode.

15 Claims, 6 Drawing Sheets

U.S. PATENT DOCUMENTS 3,007,070 A 10/1961 Cargill, Jr.
3,317,722 A 5/1967 Whitney
3,358,137 A 12/1967 Sinclair et al.
3,581,308 A 5/1971 McNaney
3,619,714 A 11/1971 Evans et al.
3,648,235 A 3/1972 Cahill
3,793,517 A 2/1974 Carlini
4,010,032 A 3/1977 Ono et al.
4,020,389 A 4/1977 Dickson et al.
4,090,232 A 5/1978 Golden
4,138,620 A 2/1979 Dickson
4,143,297 A 3/1979 Fischer
4,143,404 A 3/1979 Armstrong et al.
4,195,328 A 3/1980 Harris, Jr.
4,225,408 A 9/1980 Barlow et al.
4,234,907 A 11/1980 Daniel
4,266,164 A 5/1981 Schroeder
4,279,726 A 7/1981 Baird et al.
4,319,308 A 3/1982 Ippoliti et al.
4,480,293 A 10/1984 Wells
4,486,487 A 12/1984 Skarp
4,559,586 A 12/1985 Slarve
4,570,206 A 2/1986 Deutsch
4,571,350 A 2/1986 Parker et al.
4,617,195 A 10/1986 Mental
4,626,742 A 12/1986 Mental
4,645,970 A 2/1987 Murphy
4,652,981 A 3/1987 Glynn
4,667,274 A 5/1987 Daniel
4,709,307 A 11/1987 Branom
4,748,375 A 5/1988 Lindmayer
4,803,402 A 2/1989 Raber et al.
4,829,213 A 5/1989 Pecile et al.
4,862,331 A 8/1989 Hanabusa
4,875,144 A 10/1989 Wainwright
4,877,995 A 10/1989 Thioulouse et al.
4,887,003 A 12/1989 Parker
4,891,736 A 1/1990 Gouda
4,893,356 A 1/1990 Waters
4,901,211 A 2/1990 Shen
4,904,901 A 2/1990 Simopoulos et al.
4,945,458 A 7/1990 Batts et al.
D310,434 S 9/1990 Breece
4,956,752 A 9/1990 Foglietti
4,999,936 A 3/1991 Calamia et al.
5,005,306 A 4/1991 Kinstler
5,019,438 A 5/1991 Rapisarda
5,040,099 A 8/1991 Harris
5,051,654 A 9/1991 Nativi et al.
5,067,063 A 11/1991 Granneman et al.
5,111,366 A 5/1992 Rife et al.
D326,924 S 6/1992 Carroll
5,121,234 A 6/1992 Kucera
5,122,939 A 6/1992 Kazdan et al.
5,128,844 A 7/1992 Landais
5,138,539 A 8/1992 Honda et al.
5,151,678 A 9/1992 Veltri et al.
5,198,723 A 3/1993 Parker
5,293,098 A 3/1994 Brownell
5,317,488 A 5/1994 Penrod
5,319,282 A 6/1994 Winsor
5,352,951 A 10/1994 Kardon et al.
5,400,047 A 3/1995 Beesly
5,426,792 A 6/1995 Murasko
5,466,990 A 11/1995 Winsor
5,469,019 A 11/1995 Mori
5,469,020 A 11/1995 Herrick
5,491,377 A 2/1996 Janusauskas
5,497,572 A 3/1996 Hoffman
5,502,357 A 3/1996 Kimball
5,518,561 A 5/1996 Rosa
5,533,289 A 7/1996 Hoffman
5,552,679 A 9/1996 Murasko
5,565,733 A 10/1996 Krafcik et al.
5,568,016 A 10/1996 Beard
5,572,817 A 11/1996 Chien
5,597,183 A 1/1997 Johnson
5,634,411 A 6/1997 Chasan
5,663,573 A 9/1997 Epstein et al.
5,667,417 A 9/1997 Stevenson
5,667,724 A 9/1997 Peterson
5,697,175 A 12/1997 Schwartz
5,697,305 A 12/1997 Chasan et al.
5,703,436 A 12/1997 Forrest et al.
5,814,947 A 9/1998 Brownell
5,853,905 A 12/1998 So et al.
5,856,029 A 1/1999 Burrows
5,856,030 A 1/1999 Burrows
5,856,031 A 1/1999 Burrows
5,911,496 A 6/1999 Hojnacki
5,957,564 A 9/1999 Bruce et al.
5,965,981 A 10/1999 Inoguchi et al.
5,976,613 A 11/1999 Janusauskas
5,980,976 A 11/1999 Burrows
6,013,985 A 1/2000 Green et al.
6,031,468 A 2/2000 Tsao et al.
6,050,010 A 4/2000 Garcia et al.
6,060,838 A 5/2000 Cantoni et al.
6,069,444 A 5/2000 Krafcik et al.
6,107,213 A 8/2000 Tayanaka
6,116,745 A 9/2000 Yei
6,137,221 A 10/2000 Roitman et al.
6,157,138 A 12/2000 Andersson
6,168,283 B1 1/2001 Howell
6,203,391 B1 * 3/2001 Murasko ..... 445/24
6,205,690 B1 3/2001 Heropoulos et al.
6,261,633 B1 7/2001 Burrows
6,262,531 B1 7/2001 Inoguchi et al.
6,310,589 B1 10/2001 Nishigaki et al.
6,353,291 B1 3/2002 Borgogno et al.
6,811,895 B1 * 11/2004 Murasko et al. ..... 313/506
2001/0035716 A1 * 11/2001 Murasko ..... 427/66

FOREIGN PATENT DOCUMENTS

EP 166534 1/1986
FR 1401264 4/1965
GB 2107039 4/1983
WO WO 2078035 A1 * 10/2002

OTHER PUBLICATIONS

Japanese Unexamined Patent Publication (Kokai) No. 6-275382.
Japanese Unexamined Patent Publication (Kokai) No. 63-299091.
Japanese Unexamined Patent Publication (Kokai) No. 3-163794.
Japanese Unexamined Patent Publication (Kokai) No. 5-129081.
Japanese Unexamined Patent Publication (Kokai) No. 60-218797.
Japanese Unexamined Patent Publication (Kokai) No. 3-133090.
Japanese Unexamined Utility Model Publication (Kokai) No. 63-39895.
Japanese Unexamined Patent Publication (Kokai) No. 60-133692.
Let There Be Light: Screen Printing EL Lamps For Membrane Switches, Screenprinting, Graphics and Industrial Printing, dated Jan. 1999, 5 pages.
Processing Guide for DuPont Luxprint[561] Electroluminescent Inks, DuPont Photopolymer & Electronic Materials, dated Nov. 1997, 6 pages.

* cited by examiner

METHOD OF FORMING AN ILLUMINATED DESIGN ON A SUBSTRATE

RELATED APPLICATIONS

The following application is a divisional of U.S. patent application Ser. No. 09/815,077, filed Mar. 22, 2001, now U.S. Pat. No. 6,965,196, issued Nov. 15, 2005, which is a continuation-in-part of U.S. patent application Ser. No. 09/548,560, filed Apr. 13, 2000, now abandoned, all the disclosures of which are incorporated herein by reference.

FIELD OF INVENTION

This invention relates generally to electroluminescent lamps and, more particularly, to a display signs having such lamps and a method therefor.

BACKGROUND OF THE INVENTION

Electroluminescent (EL) lighting has been known in the art for many years as a source of light weight and relatively low power illumination. Because of these attributes, EL lamps are in common use today providing light in, for example, automobiles, airplanes, watches, and laptop computers. Electroluminescent lamps of the current art generally include a layer of phosphor positioned between two electrodes, with at least one of the electrodes being light-transmissive, and a dielectric layer positioned between the electrodes. The dielectric layer enables the lamp's capacitive properties. When a voltage is applied across the electrodes, the phosphor material is activated and emits a light.

It is standard in the art for the translucent electrode to consist of a polyester film sputtered with indium-tin-oxide, which provides a serviceable translucent material with suitable conductive properties for use as an electrode. A disadvantage of the use of this polyester film method, however, is that the final shape and size of the electroluminescent lamp is dictated greatly by the size and shape of manufacturable polyester films sputtered with indium-tin-oxide. Further, a design factor in the use of indium-tin-oxide sputtered films is the need to balance the desired size of electroluminescent area with the electrical resistance (and hence light/power loss) caused by the indium-tin-oxide film required to service that area. Thus, the indium-tin-oxide sputtered films must be manufactured to meet the requirements of the particular lamps they will be used in. This greatly complicates the lamp production process, adding lead times for customized indium-tin-oxide sputtered films and placing general on the size and shape of the lamps that may be produced. Moreover, the use of indium-tin-oxide sputtered films tends to increase manufacturing costs for electroluminescent lamps of non-standard shape.

It is thus desirable to eliminate the need for conventional electroluminescent polyester film. Screen-printed ink systems have been developed that deposit layers of ink onto a substrate to provide electroluminescent lamps. It is known in the art for the light-transmissive or translucent electrode to consist of a suitable translucent electrical conductor, such as indium-tin-oxide, which is dispersed in a resin. This conductive layer of the Electroluminescent lamp is in electrical contact with an electrode lead or bus bars. It is further standard in the art for the dielectric layer to be comprised of barium-titanate particles suspended in a cellulose-based resin. Particularly with known screen printing techniques for applying the separate layers of electroluminescent lamps, the dielectric layer tends to deposit with pin-holes in the layers or have channels therein because of the granular nature of the barium titanate. Such pin-holes and channels in the dielectric layer may cause breakdown of the capacitive structure of electroluminescent lamp, particularly at the area of the crossover of the light-transmissive electrode lead over the rear electrode. This is due to silver from either the light-transmissive electrode lead or the opaque electrode migrating through the pinholes and channels through the dielectric layer to other electrode lead. This short circuits the electroluminescent lamp and results in electroluminescent lamp failure.

It is accordingly an object of the present invention to configure the electroluminescent lamp system to minimize crossover between the light-transmissive and opaque electrodes. This decreases current leakage and thus increases the efficiency of the capacitor and maintains a sufficiently low capacitive reactance to create a bright electroluminescent lamp It is another object of the present invention to provide an electroluminescent lamp system that may be directly manufactured to the product.

Electroluminescent lamps in the art typically are manufactured as discrete cells on either rigid or flexible substrates. One known method of fabricating an electroluminescent lamp includes the steps of applying a coating of light-transmissive conductive material, such as indium tin oxide, to a rear surface of polyester film, etching the film to create a pattern, applying a phosphor layer to the conductive material, applying at least one dielectric layer to the phosphor layer, applying a rear electrode to the dielectric layer, and applying an insulating layer to the rear electrode. In order to obtain a colored graphical display, the graphical layers are separately constructed and then the various layers may, for example, be laminated together utilizing heat and pressure. Alternatively, the various layers may be screen printed to each other. When a voltage is applied across the indium tin oxide and the rear electrode, the phosphor material is activated and emits a light which is visible through the polyester film.

Typically, it is not desirable for the entire electroluminescent polyester film to be light emitting. For example, if an electroluminescent lamp is configured to display a word, it is desirable for only the portions of the electroluminescent polyester film corresponding to letters in the word to be light emitting. Accordingly, the indium tin oxide is applied to the polyester film so that only the desired portions of the film will emit light. For example, the entire polyester film may be coated with indium tin oxide, and portions of the indium tin oxide may then be removed with an acid etch to leave behind discrete areas of illumination. Alternatively, an opaque ink may be printed on a front surface of the polyester film to prevent light from being emitted through the entire front surface of the film.

Fabricated electroluminescent lamps often are affixed to products, e.g., signs, and watches, to provide lighting for such products. For example, Electroluminescent lamps typically are utilized to provide illuminated images on display signs. Particularly, and with respect to a display sign, electroluminescent lamps are bonded to the front surface of the display sign so that the light emitted by the phosphor layers of such lamps may be viewed from a position in front of the sign.

Utilizing prefabricated electroluminescent lamps to form an illuminated display sign is tedious. Particularly, each electroluminescent lamp must be formed as a reverse image. For example, when utilizing an electroluminescent lamp to display an illuminated word, e.g., "THE", it is important that the word be accurate, i.e., be readable from left to right, when viewed from the front of the sign. Accordingly, and until now, it was necessary to apply the indium tin oxide to the polyester film as a reverse image, e.g., as a reverse image of "THE". The subsequent layers of phosphor, dielectric, and rear electrode then are similarly applied as reverse images. In addition, it is possible that the electroluminescent lamp may become damaged while bonding the electroluminescent lamp to the sign.

A need in the art therefore exists for an electroluminescent system that minimizes failures by reducing areas of cross-over between the front electrode or electrode lead and the rear electrode and/or rear electrode lead. A further need exists for a electroluminescent system that prevents migration of conductive material through the dielectric layer. Further a need exists for such electroluminescent systems to be layered directly to the product.

BRIEF SUMMARY OF THE INVENTION

The present invention addresses the above-described problems of electroluminescent lamps standard in the art by providing an electroluminescent system in which at least one of a conductive layer and an illumination layer extends beyond the perimetry of an opaque electrode for the system. The transparent electrode lead circumbscribes at least one of the conductive layer and the illumination layer such that the electrode lead is substantially not over the opaque electrode.

In one embodiment, a sign includes an electroluminescent lamp integrally formed therewith. The electroluminescent lamp is formed on the sign by using the sign as a substrate for the electroluminescent lamp and performing the steps of screen printing a rear electrode to a front surface of the sign, screen printing at least one dielectric layer over the rear electrode after screen printing the rear electrode to the sign, screen printing a phosphor layer over the dielectric layer to define a desired area of illumination that is smaller in area than the dielectric layer, screen printing a sealant layer over the remaining portion of the dielectric layer, screen printing a layer of indium tin oxide ink to the phosphor layer, screen printing an outlining electrode layer to the sign that outlines the rear electrode, screen printing an outlining insulating layer to the outlining electrode layer, screen printing a background layer onto the sign so that the background layer substantially surrounds the desired area of illumination, and applying a protective coat over the indium tin oxide ink and background layer. The rear electrode of each lamp is screen printed directly to the front surface of the sign, and the other layers of the electroluminescent lamp are screen printed over the rear electrode.

The above described method provides an illuminated sign having electroluminescent lamps but does not require coupling prefabricated electroluminescent lamps to the sign. Such method also facilitates applying the various layers of the electroluminescent lamps to the electroluminescent substrate as a forward image and, alternatively, as a reverse image.

DETAILED DESCRIPTION OF THE INVENTION

Figure 1:
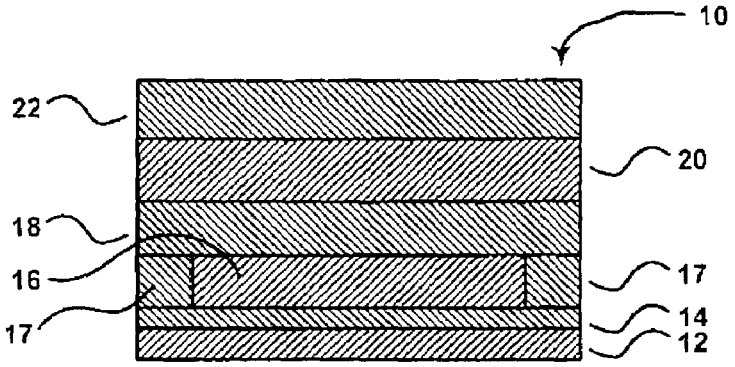
FIG. 1 is a schematic illustration of an electroluminescent lamp.

FIG. 1 is a schematic illustration of one embodiment of an electroluminescent (EL) lamp 10 of the present invention. The electroluminescent lamp 10 includes a substrate 12 having a coating of light-transmissive conductive material, a front electrode 14, a phosphor layer 16, a sealant layer 17, a dielectric layer 18, a rear electrode 20 of conductive particles, and a protective coating layer 22. Substrate 12 may, for example, be a polyethylene terephthalate) (PET) film coated with indium tin oxide. Front electrode 14 is preferably formed from silver particles. Phosphor layer 16 may be formed of electroluminescent phosphor particles, e.g., zinc sulfide doped with copper or manganese which are dispersed in a polymeric binder. Dielectric layer 18 may be formed of high dielectric constant material, such as barium titanate dispersed in a polymeric binder. Rear electrode 20 is formed of conductive particles, e.g., silver or carbon, dispersed in a polymeric binder to form a screen printable ink. Protective coating 22 may, for example, be an ultraviolet (UV) coating.

Figure 2:
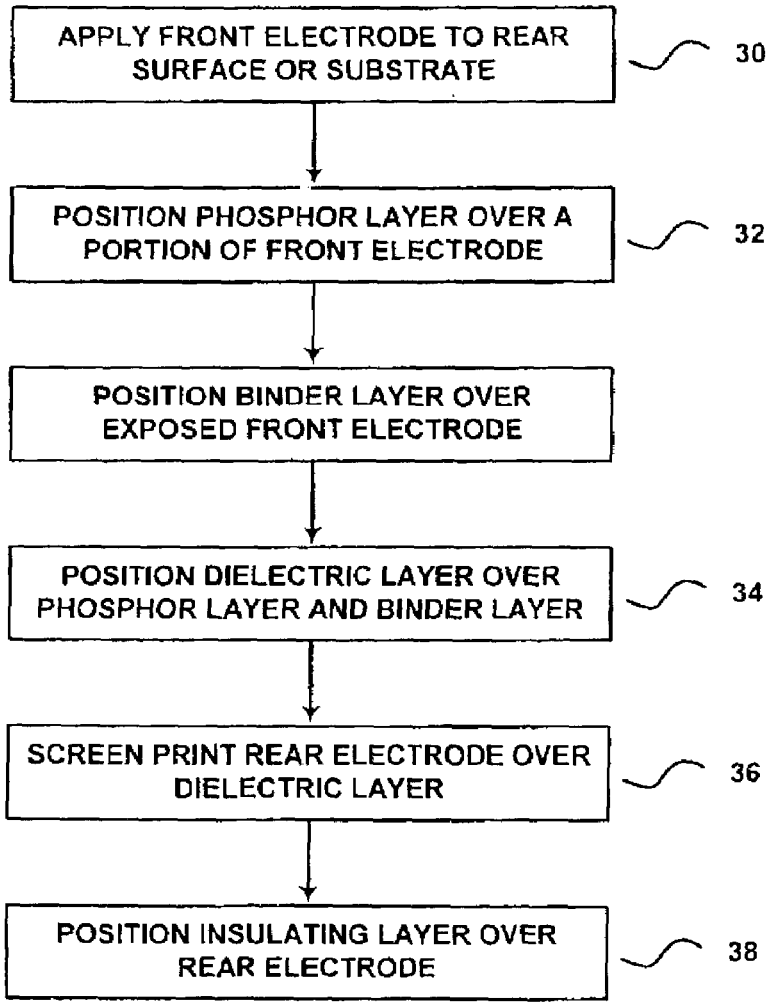
FIG. 2 is a flow chart illustrating a sequence of steps for fabricating the electroluminescent lamp shown in FIG. 1.

Referring now to FIG. 2, electroluminescent lamp 10 is fabricated by applying 30 front electrode 14, e.g., silver particles, to a rear surface of substrate 12, which has a coating of indium tin oxide thereon. For example, indium tin oxide may be sputtered onto the polyester film and then silver particles may be applied to the indium tin oxide. Alternatively, it will be understood by those skilled in the art that the indium tin oxide may be deposited on the substrate as a separate layer without departing from the scope of the present invention. Phosphor layer 16 then is positioned 32 over front electrode 14 such that the phosphor layer does not extend the entire extent of the layer of silver particles. A sealant layer 17 is then printed onto the substrate 12 on the portion of the silver particles that is not covered by the phosphor layer. The dielectric layer 18 is positioned 34 over phosphor layer 16 and sealant layer 17. Rear electrode 20 is then screen printed 36 over dielectric layer 18, and insulating layer 22 is positioned over rear electrode 20 to substantially prevent possible shock hazard or to provide a moisture barrier to protect lamp 10. The various layers may, for example, be laminated together utilizing heat and pressure.

A background layer (not shown) is then applied to insulating layer 22. The background layer is applied to substrate 12 such that only the background layer and front electrode 14 are visible from a location facing a front surface of substrate 12. The background layer may include, for example, conventional UV screen printing ink and may be cured in a UV drier utilizing known sign screening practices.

Figure 3:
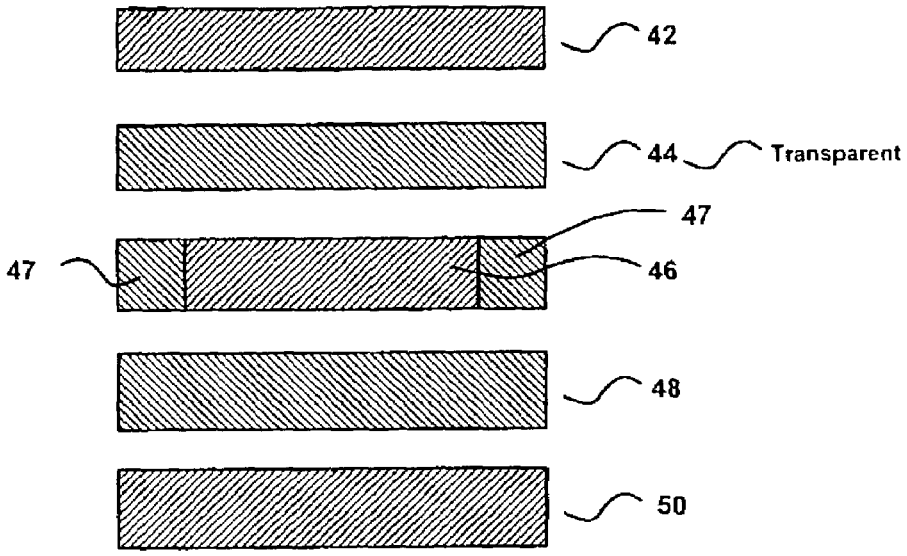
FIG. 3 is a schematic illustration of an electroluminescent lamp in accordance with one embodiment of the present invention.
Figure 4:
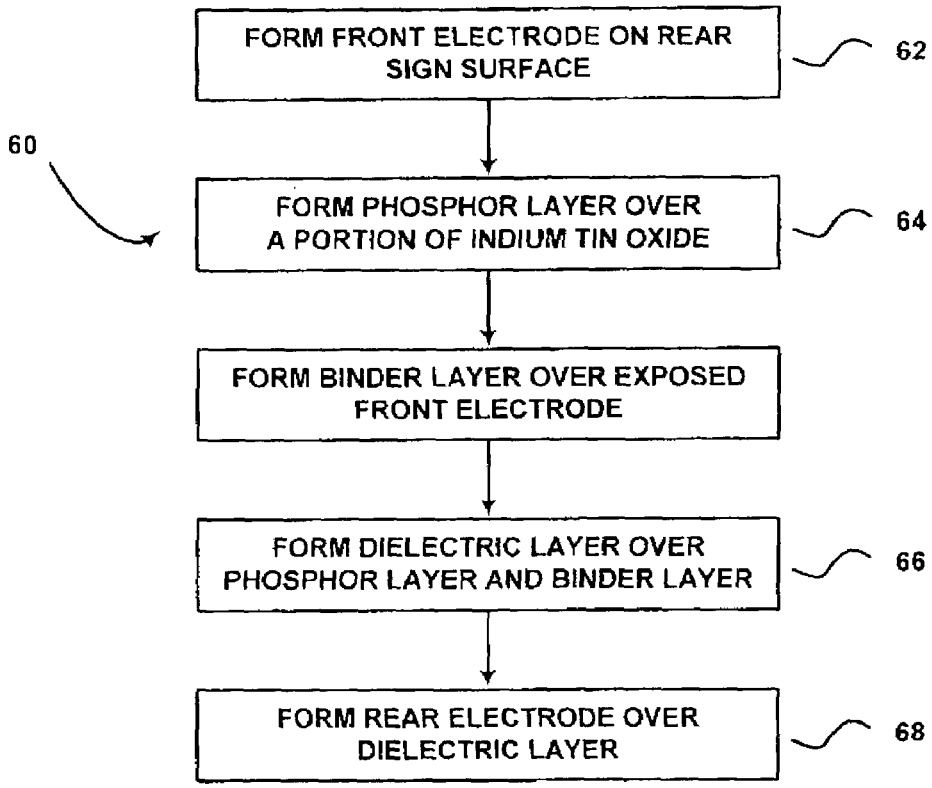
FIG. 4 is a flow chart illustrating a sequence of steps for fabricating the electroluminescent lamp shown in FIG. 3.
Figure 5:
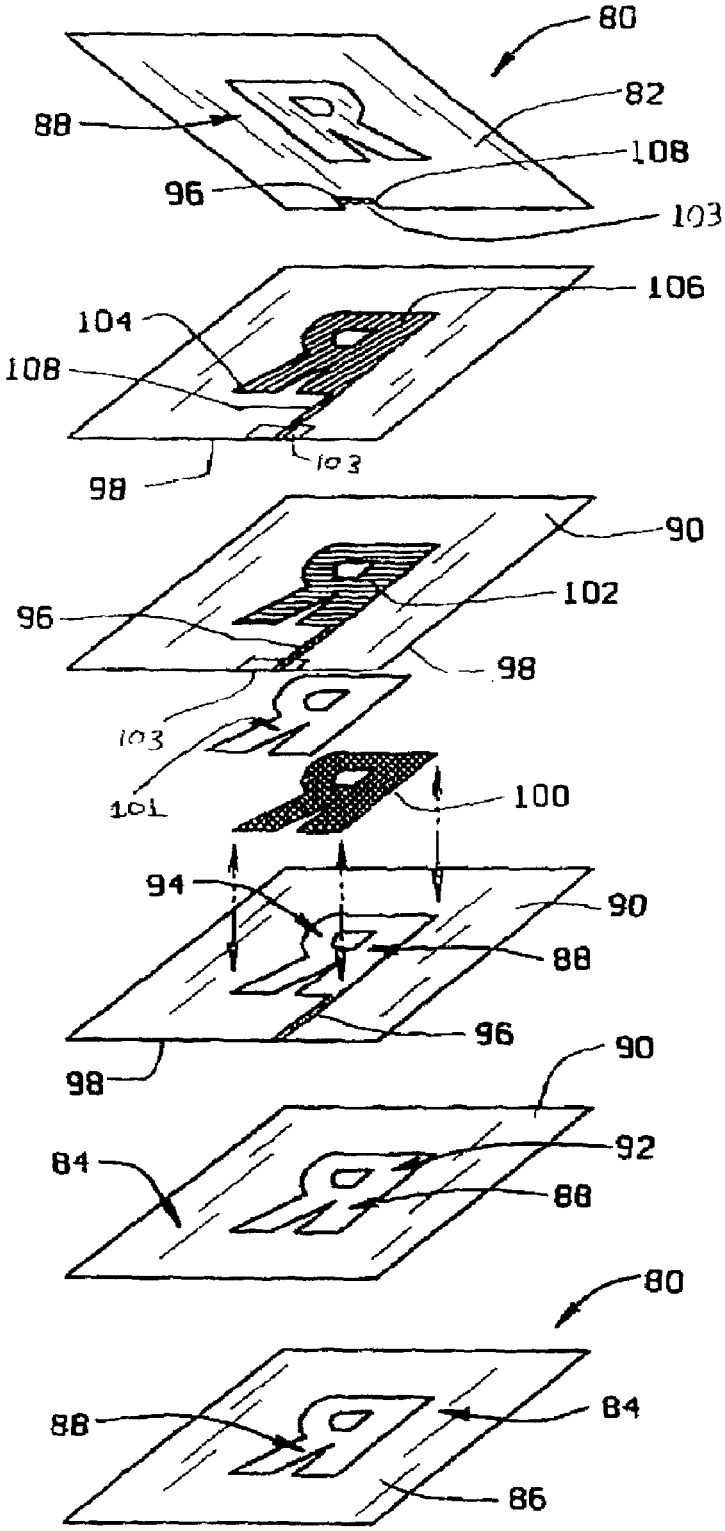
FIG. 5 is an exploded pictorial illustration of an electroluminescent lamp fabricated in accordance with the steps shown in FIG. 4.

FIGS. 3–5 disclose an alternative electroluminescent (EL) lamp 40 that is negatively built (e.g., the image is reversed)

on a substrate. The EL lamp 40 includes a substrate 42 having a coating of light-transmissive conductive material, a front electrode 44, a phosphor layer 46, a sealant layer 47, a dielectric layer 48, a rear electrode 50, and a protective coating layer (not shown). Substrate 42 may, for example, be a polyester film coated with indium tin oxide. Alternatively, it will be understood by those skilled in the art that the indium tin oxide may be deposited on the substrate as a separate layer without departing from the scope of the present invention. Front electrode 44 may be formed from silver particles that form a screen printable ink which is UV curable. For example, a UV curable screen-printable ink is available from Allied Photo Chemical Inc., Port Huron, Mich.

Phosphor layer 46 may be formed of electroluminescent phosphor particles, e.g., zinc sulfide doped with copper or manganese which are dispersed in a polymeric binder to form a screen printable ink. In one embodiment, the phosphor screen printable ink may be UV curable. For example, a UV-curable, screen-printable phosphor ink that is available Allied PhotoChemical Inc, of Port Huron, Mich.

Sealant layer 47 is a solvent based in a carrier to form of a clear sealant, such as DuPont 7155, Electroluminescent Medium. Dielectric layer 48 may be formed of high dielectric constant material, such as barium titanate dispersed in a polymeric binder to form a screen printable ink. In one embodiment, the dielectric screen printable ink may be UV curable such as are available from Allied Photochemical, Inc., of Port Huron, Mich. Rear electrode 50 is formed of conductive particles, e.g., silver or carbon, dispersed in a polymeric binder to form a screen printable ink. In one embodiment, rear electrode 50 may be UV curable, such as available from Allied PhotoChemical Inc, of Port Huron, Mich. The protective coating may, for example, be an ultraviolet (UV) coating such as available from Allied PhotoChemical Inc, of Port Huron, Mich.

In an alternative embodiment, EL lamp 40 does not include dielectric layer 48. Since the UV curable phosphor screen printable ink (available from) Allied PhotoChemical Inc, of Port Huron, Mich. includes an insulator in the binder, EL lamp 40 does not require a separate dielectric layer over phosphor layer 46.

FIGS. 4 and 5 illustrate a method 60 of fabricating EL lamp 40 (shown in FIG. 3). Particularly referring to FIG. 5, a substantially clear heat stabilized polycarbonate substrate 80, e.g., a plastic substrate, having a front surface 82 and a rear surface 84 is first positioned in an automated flat bed screen printing press (not shown in FIG. 5). Substrate 80 includes a layer of indium tin oxide and is positioned in the flat bed printing press such that the layer of indium tin oxide is facing up. Alternatively, it will be understood by those skilled in the art that the indium tin oxide may be deposited on the substrate as a separate layer without departing from the scope of the present invention. A background substrate 86 is screen printed onto rear surface 84 and covers substantially entire rear surface 84 except for an illumination area 88 thereof. Illumination area 88 is shaped as a reverse image, e.g., a reverse image of "R", of a desired image to be illuminated, e.g., an "R".

A dielectric background layer 90 is then screen printed over sign rear surface 84 and background substrate 86. Dielectric background layer 90 covers substantially entire background substrate 86 and includes an illumination portion 92 which is substantially aligned with illumination area 88. In one embodiment, background layer 90 is a decorative layer utilizing UV four color process and substantially covers background substrate 86 except for illumination area 88. Alternatively, the decorative layer is printed directly over illumination area 88 to provide a graduated, halftone, grainy illumination.

A front electrode 94 fabricated from silver ink is then screen printed onto sign rear surface 84 so that front electrode 94 contacts an outer perimeter of illumination portion 92. In addition, a lead 96 of front electrode 94 extends from the perimeter of illumination portion 92 to a perimeter 98 of EL lamp 40. Front electrode 94 is then UV cured for approximately two to five seconds under a UV lamp.

After screen printing front electrode 94 to sign surface 84, a phosphor layer 100 is screen printed onto the illumination portion 92 bounded by front electrode 94. In this embodiment, phosphor layer 100 is screened as a reverse image. Phosphor layer 100 is then UV cured, for example, for approximately two to five seconds under a UV lamp.

A sealant layer 101 is then screen printed onto the front electrode 94 and preferably not phosphor layer 100. Sealant layer 101 is preferably a solvent based in a screen-printable carier. Sealant layer 101 is then UV cured, for example, for approximately two to five seconds under a UV lamp.

A dielectric layer 102 is then screen printed onto sign surface 84 so that dielectric layer 102 covers substantially the entire phosphor layer 100, sealant layer 101 and covers entirely front electrode 94 with the exception of an interconnect tab portion 103. In one embodiment, interconnect tab portion 103 is about 0.5 inches long by about 1.0 inches wide. Dielectric layer 102 includes two layers (not shown) of high dielectric constant material. The first layer of dielectric layer 102 is screen printed over phosphor layer 100 and is then UV cured to dry for approximately two to five seconds under a UV lamp. The second layer of dielectric layer 102 is screen printed over the first layer of barium titanate and UV cured to dry for approximately two to five seconds under a UV lamp to form dielectric layer 102. In accordance with one embodiment, dielectric layer 102 has substantially the same shape as illumination area 88, but is approximately 2% larger than illumination area 88 and is sized to cover at least a portion of front electrode lead 96.

A rear electrode 104 is screen printed to rear surface 84 over dielectric layer 102 and includes an illumination portion 106 and a rear electrode lead 108. Illumination portion 106 is substantially the same size and shape as illumination area 88, and rear electrode lead 108 extends from illumination portion 106 to sign perimeter 98. Art work used to create a screen for phosphor layer 100 is created using the same art work used to create a screen for rear electrode 104 except that the screen for rear electrode 104 does not include rear electrode lead 108. However, two different screens are utilized for phosphor layer 100 and rear electrode 104 since each one is for a different mesh count. Rear electrode 104, dielectric layer 102, phosphor layer 100, and front electrode 94 form EL lamp 40 extending from rear surface 84 of substrate 80.

Subsequently, a UV clear coat (not shown in FIG. 5) is screen printed to rear surface 84 and covers rear electrode 104, dielectric layer 102, phosphor layer 100, sealant layer 101, front electrode 94, dielectric background layer 90 and background layer 86. Particularly, the UV clear coat covers entire rear surface 84. In an alternative embodiment, the UV clear coat covers substantially entire rear surface 84 except for interconnect tab portion 103. Interconnect tab portion 103 is left uncovered to facilitate attachment of a slide connector (not shown) and a wire harness (not shown) from a power supply (not shown) to front electrode lead 96 and rear electrode lead 108.

In an alternative embodiment, the EL sign includes a transparent reflective coating which is reflective to oncoming light, such as car headlights, in order to provide greater visibility of the sign at night. Glass beads or spheres having an optimal index of refraction in the range of 1.9 to 2.1 are mixed with an overprint clear ink. The clear ink may be a UV clear ink available from Nazdar, 8501 Hedge Lane Terrace, Shawnee, Kans. Alternatively, the clear ink may be thermally cured, such as Nazdar 9727 available from Nazdar. The transparent reflective coating may be printed directly on the polycarbonate as the first layer of the sign. The transparent reflective coating allows the color details of EL sign to be visible to a person viewing the EL sign through the polycarbonate substrate.

Method 60 (shown in FIG. 4) provides a sign capable of illuminating via an EL lamp. The sign does not utilize coupling or laminating with heat, pressure, or adhesive, to attach by hand or other affixing method a prefabricated EL lamp to the sign.

Figure 6:
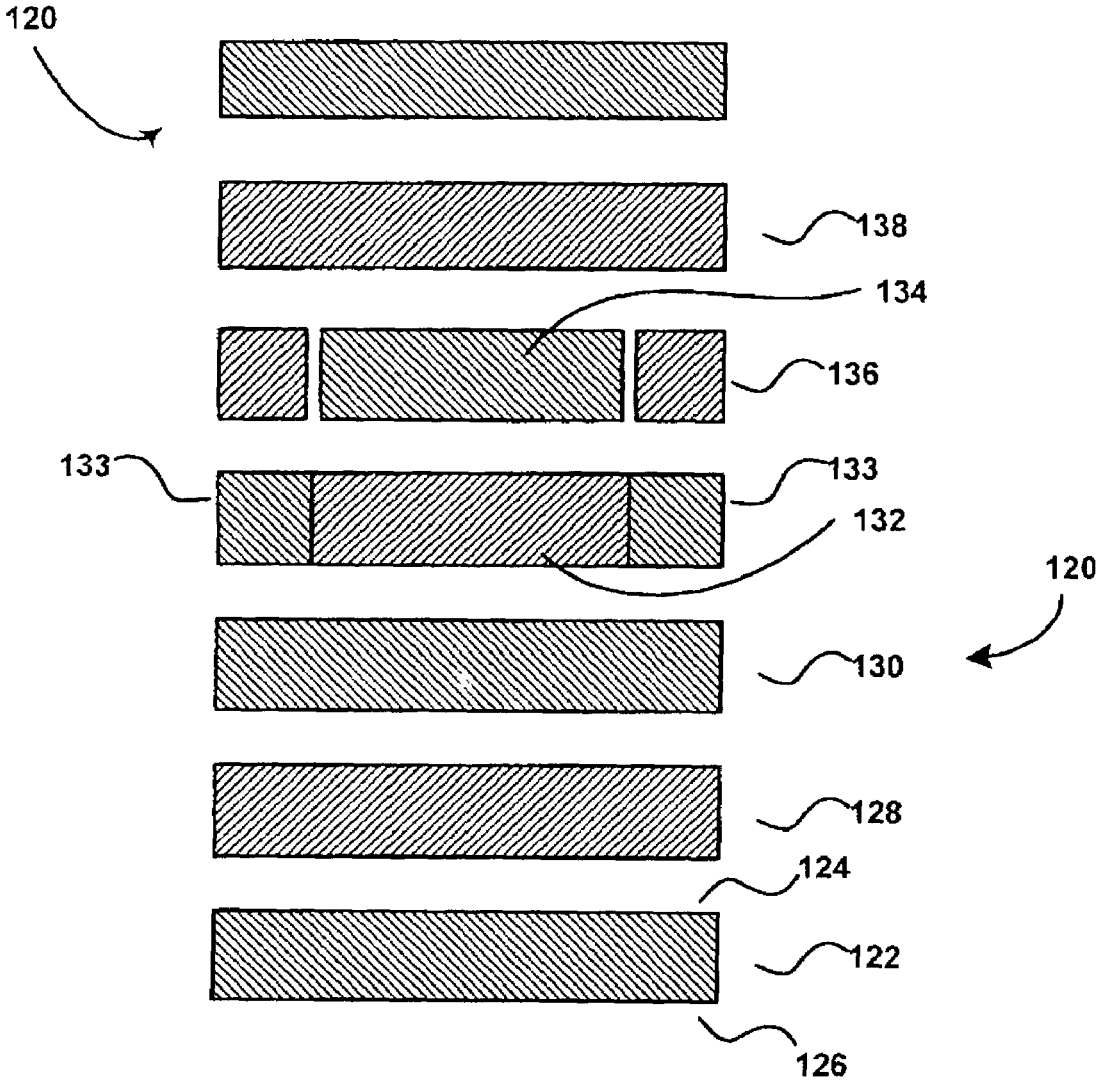
FIG. 6 is a schematic illustration of an electroluminescent lamp in accordance with an alternative embodiment of the present invention.
Figure 7:
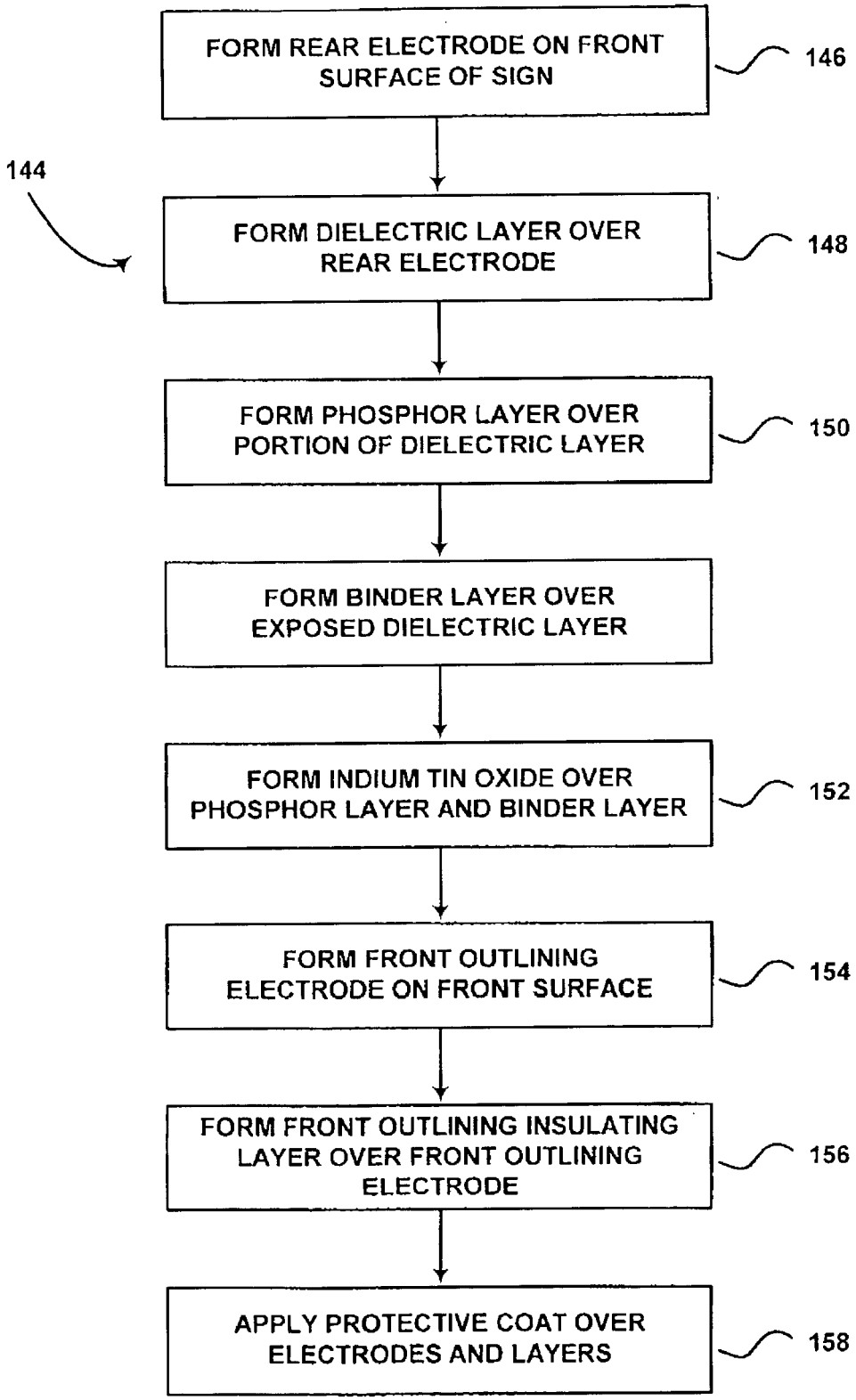
FIG. 7 is a flow chart illustrating a sequence of steps for fabricating the electroluminescent lamp shown in FIG. 6.

FIGS. 6 and 7 disclose an alternative embodiment of an EL lamp 120 including a substrate 122. Substrate 122, in one embodiment, is a paper based substrate, such as card board or 80 point card stock, and includes a front surface 124 and a rear surface 126. A rear electrode 128 is formed on front surface 124 of substrate 122. Rear electrode 128 is formed of conductive particles, e.g., silver or carbon, dispersed in a polymeric binder to form a screen printable ink. In one embodiment, rear electrode 128 is heat curable available from Dupont, of Wilmington, Del. In an alternative embodiment, rear electrode 128 is UV curable such as available from Allied PhotoChemical Inc, of Port Huron, Mich.

A dielectric layer 130 is formed over rear electrode 128 from high dielectric constant material, such as barium titanate dispersed in a polymeric binder to form a screen printable ink. In one embodiment, the dielectric screen printable ink is heat curable such as available from Dupont, of Wilmington, Del. In an alternative embodiment, dielectric layer 130 is UV curable available from Allied PhotoChemical Inc, of Port Huron, Mich.

A phosphor layer 132 is formed over dielectric layer 130 and may be formed of electroluminescent phosphor particles, e.g., zinc sulfide doped with copper or manganese that are dispersed in a polymeric binder to form a screen printable ink. In one embodiment, the phosphor screen printable ink is heat curable available from Dupont, of Wilmington, Del. In an alternative embodiment, phosphor layer 132 is UV curable such as available from Allied PhotoChemical Inc, of Port Huron, Mich.

A sealant layer 133 is formed over dielectric layer 130 and is preferably a solvent based in a screen-printable carrier. Sealant layer 133 is then UV cured, for example, for approximately two to five seconds under a UV lamp.

A conductor layer 134 is formed on phosphor layer 132 from indium-tin-oxide particles that form a screen printable ink which is heat curable available from Dupont, of Wilmington, Del. In an alternative embodiment, conductor layer 134 is UV curable available from Allied PhotoChemical Inc, of Port Huron, Mich.

A front outlining electrode 136 is formed on lamp 120 from silver particles that form a screen printable ink which is heat curable available from Dupont, of Wilmington, Del. In an alternative embodiment, front outlining electrode 136 is UV curable available from Allied PhotoChemical Inc, of Port Huron, Mich.

A front outlining insulating layer 138 is formed over front outlining electrode 136 from high dielectric constant material, such as barium titanate dispersed in a polymeric binder to form a screen printable ink. In one embodiment, the front outlining insulator is heat curable available from Dupont, of Wilmington, Del. In an alternative embodiment, front outlining insulator 138 is UV curable available from Allied PhotoChemical Inc, of Port Huron, Mich.

A protective coating 140 formed, for example, from a ultraviolet (UV) coating available from Dupont, of Wilmington, Del. is then formed on lamp 120 over rear electrode 128, dielectric layer 130, phosphor layer 132, sealant layer 133, conductor layer 134, front outlining electrode 136, and front outlining insulating layer 138.

FIG. 7 illustrates a sequence of steps 140 for fabricating EL lamp 120. EL lamp 120 may, for example, have a metal substrate, e.g., 0.25 mm gauge aluminum, a plastic substrate, e.g., 0.15 mm heat stabilized polycarbonate, or a paper based substrate, e.g., 80 pt. card stock. With respect to an EL lamp utilizing a plastic substrate, a rear electrode is formed 142 on a front surface of EL lamp 120. Next, a dielectric layer is formed 144 over the rear electrode and extends beyond an illumination area for the design. Subsequently, a phosphor layer is formed 146 over the dielectric layer and preferably is formed to define the illumination area. A sealant layer is then formed 147 over the remaining exposed portion of the dielectric layer. A layer of indium tin oxide ink is formed 148 over the phosphor layer, a front outlining electrode is then formed 150 on the sealant layer and a front outlining insulating layer is formed 152 on the front outlining electrode layer. A protective coat is then applied 154 over the layers of the EL lamp 120.

Figure 8:
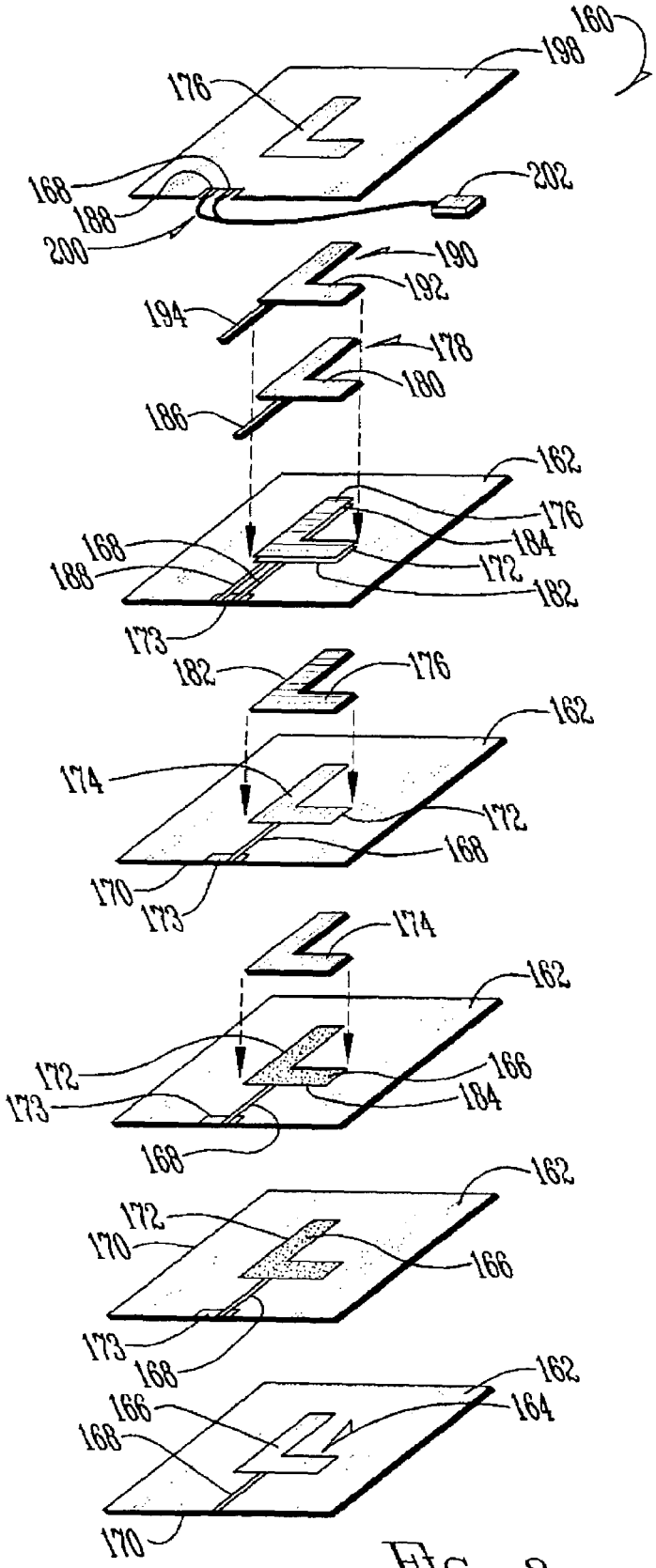
FIG. 8 is an exploded pictorial illustration of an electroluminescent lamp fabricated in accordance with the steps shown in FIG. 7.

More particularly, and referring now to FIG. 8, an EL sign 160 includes a plastic substrate. The substrate has a front surface 162 and a rear surface (not shown) and is first positioned in an automated flat bed screen printing press (not shown). A rear electrode 164, such as screen printable carbon or silver, having an illumination area 166 and a rear electrode lead 168 is screen printed onto front surface 162 of sign 160. Illumination portion 166 defines a shape, e.g., an "L" representative of the ultimate image to be illuminated by sign 160, although not extending to the extent of an illumination area hereinafter defined.

Rear electrode lead 168 extends from illumination area 166 to a perimeter 170 of sign front surface 162. Rear electrode 164 is screen printed as a positive, or forward, image, e.g., as "L" rather than as a reverse "L". After printing rear electrode 164 on front surface 162, rear electrode 164 is cured to dry. For example, rear electrode 164 and sign 160 may be positioned in a reel to reel oven for approximately two minutes at a temperature of about 250–350 degrees Fahrenheit. In an alternative embodiment, rear electrode 164 and sign 160 are cured by exposure to UV light for about two to about five seconds.

In one embodiment, rear electrode 164 is screen printed in halftones to vary the light emitting characteristics of sign 160. In one embodiment, the amount of silver utilized in the halftone rear electrode layer varies from about 100% to about 0%. The rear electrode silver halftone area provides a fading of the silver particles from a first area of total coverage to a second area of no coverage which allows for dynamic effects such as the simulation of a setting sun.

A dielectric layer 172 is then screen printed onto lamp surface 162 so that dielectric layer 172 covers substantially the entire illumination portion 166 while leaving rear electrode lead 168 covered entirely except for an interconnect tab portion 173. In one embodiment, interconnect tab portion 173 is about 0.5 inches wide by about 1.0 inch long. Dielectric layer 172 includes two layers (not shown) of high dielectric constant material, such as barium titanate dispersed in a polymeric binder. The first layer of barium titanate is screen printed over rear electrode 164 and cured to dry for approximately two minutes at a temperature of about 250–350 degrees Fahrenheit. In an alternative embodiment, the first layer of barium titanate is cured by exposure to UV light for about two to about five seconds.

The second layer of barium titanate is screen printed over the first layer of barium titanate and cured to dry for approximately two minutes at a temperature of about 250–350 degrees Fahrenheit to form dielectric layer 172. In an alternative embodiment, the second layer of barium titanate is cured by exposure to UV light for about two to about five seconds. In accordance with one embodiment, dielectric layer 172 has substantially the same shape as illumination portion 166, but is approximately 5%–25% larger than illumination portion 166.

In an alternative embodiment, dielectric layer includes a high dielectric constant material such as alumina oxide dispersed in a polymeric binder. The alumina oxide layer is screen printed over rear electrode 164 and cured by exposure to UV light for about two to about five seconds.

After screen printing dielectric layer 172 and rear electrode 164 to lamp surface 162, a phosphor layer 174 is screen printed onto sign surface 162 over dielectric layer 172. Phosphor layer 174 is screened as a forward, or positive, image, e.g., as "L", rather than a reverse image, e.g., as a reverse image of "L". Phosphor layer has substantially the same shape as illumination portion 166 and is approximately 5% to 15% larger than illumination portion 166 to define an illumination area 175. Art work utilized to create a screen for phosphor layer 174 is the same art work utilized to create a screen for rear electrode 164, except for rear electrode lead 168. However, two different screens are utilized for phosphor layer 174 and rear electrode 164 since each screen is specific to a different mesh count. Phosphor layer 174 is then cured, for example, for approximately two minutes at about 250–350 degrees Fahrenheit. In an alternative embodiment, phosphor layer 174 is cured by exposure to UV light for about two to about five seconds.

In one embodiment, phosphor layer 174 is screen printed in halftones to vary the light emitting characteristics of sign 160. In one embodiment, the amount of phosphor utilized in the halftone phosphor layer varies from about 100% to about 0%. The halftone area provides a fading of the light particles from a first area of total brightness to a second area of no brightness which allows for dynamic effects such as the simulation of a setting sun.

A sealant layer 177 is screen printed onto sign surface 162 over the remaining exposed portions of dielectric layer 172. Sealant layer 177 is then cured, for example, for approximately two minutes at about 250–350 degrees Fahrenheit. In an alternative embodiment, sealant layer 175 is cured by exposure to UV light for about two to about five seconds.

A conductor layer 176 formed from indium-tin-oxide is screen printed over phosphor layer 174. Conductor layer 176 has substantially the same shape and size as illumination area 175 and may, for example, be screen printed with the same screen utilized to print phosphor layer 174. Conductor layer 176 also is printed as a forward image and is cured, for example, for approximately two minutes at about 250–350 degrees Fahrenheit. In an alternative embodiment, conductor layer 176 is cured by exposure to UV light for about two to about five seconds.

In one embodiment, conductor layer is non-metallic and is translucent and transparent, and is synthesized from a conductive polymer, e.g., polyphenyleneamine-imine. The non-metallic conductor layer is heat cured for approximately two minutes at about 200 degrees Fahrenheit.

Subsequently, a front electrode or bus bar—hereinafter front outlining electrode layer 178—fabricated from silver ink is screen printed onto lamp surface 162 over sealant layer 175 to outline the illumination area 175. Front outlining electrode is configured to transport energy to conductor layer 176. Particularly, front electrode 178 is screen printed to lamp surface 162 so that a first portion 180 of front outlining electrode layer 178 contacts an outer perimeter 182 of conductor layer 176. In addition, first portion 180 contacts an outer perimeter 184 of illumination area 166 and an outer perimeter 186 of a front electrode lead 188 which extends from illumination area 166 to perimeter 170 of sign surface 162. Front outlining electrode layer 178 is then cured for approximately two minutes at about 250–350 degrees Fahrenheit. In an alternative embodiment, front outlining electrode layer 178 is cured by exposure to UV light for about two to about five seconds.

In a preferred embodiment, front outlining electrode layer 178 is configured such that it contacts substantially the entire outer perimeter 182 of conductor layer 176 and overlaps rear electrode 164 only at the rear electrode lead 168. This minimized crossover design having an additional sealant layer 177 that seals any pinholes and channels in the dielectric layer significantly reduces failures of the lamp. In an alternative embodiment, front electrode first portion 180 contacts only about 25% of outer perimeter 182 of conductor layer 176. Of course, front electrode first portion 180 could contact any amount of the outer perimeter of conductor layer 176 from about 25% to about 100%.

In an alternative embodiment, the order of application of conductor layer 176 and front outlining electrode layer 178 is reversed such that front outlining electrode layer 176 is applied immediately after phosphor layer 174 is applied, and conductor layer 176 is applied after front outlining electrode layer 178. A front outlining insulator layer 190 is then applied immediately after conductor layer 176.

A front outlining insulator layer 190 is screen printed onto front outlining electrode layer 178 and covers front outlining electrode 178 and extends beyond both sides of front outlining electrode by about 0.125 inches. Front outlining insulator layer 190 is a high dielectric constant material, such as barium titanate dispersed in a polymeric binder. Front outlining insulator layer 190 is screen printed onto front outlining electrode layer 178 such that front outlining insulator layer 190 covers substantially the entire front outlining electrode layer 178. Front outlining insulator layer 190 is cured for approximately two minutes at about 250–350 degrees Fahrenheit. In an alternative embodiment, front outlining insulator layer 190 is cured by exposure to UV light for about two to about five seconds.

The size of front outlining insulating layer 190 depends on the size of front outlining electrode layer 178. Front outlining electrode layer 190 thus includes a first portion 192 that substantially covers front outlining electrode layer first portion 180 and a second portion 194 that substantially covers front electrode lead 188 which extends from illumination area 166 to perimeter 170 of lamp 162. Interconnect tab portion 173 of front electrode lead 188 remains uncovered so that a power source 196 can be connected thereto. Rear electrode 164, dielectric layer 172, phosphor layer 174, conductor layer 176, front outlining electrode layer 178, and front outlining insulating layer 190 form EL sign 160 extending from front surface 162 of the substrate.

A decorative background layer 198 utilizing a four-color process is then screen printed on front surface 162 of sign 160. Background layer 198 substantially covers front surface 162 except for illumination area 166 and tab interconnect portion 173. However, in some cases, background layer 198 is printed directly over illumination area 166 to provide a gradated, halftone, grainy illumination quality.

Particularly, background layer 198 is screen printed on front surface 162 so that substantially only background layer 198 and conductor layer 176 are visible from a location facing front surface 162. Background layer 198 may include, for example, conventional UV screen printing ink and may be cured in a UV dryer utilizing known sign screening practices.

In one embodiment, background layer 198 is screen printed in halftones to vary the light emitting characteristics of sign 160. In one embodiment, the amount of ink utilized in the halftone background layer varies from about 100% to about 0%. The halftone area provides a fading of the coloration from a first area of total coverage to a second area of no coverage which allows for dynamic coloration effects.

In one embodiment, a thermochromatic ink, available from Matsui Chemical Company, Japan, is used in place of the four color process from background layer 198. The thermochromatic ink is utilized to print the background of EL sign 160. Once printed in the thermochromatic ink, the background design will change colors due to the temperature of EL sign 160.

For example, an EL sign originally includes a background, printed with a yellow thermochromatic ink, a first shape, and a second shape printed thereon. Both shapes are printed with phosphor, allowing the shapes to illuminate when connected to a power supply. In addition, the first shape is overprinted with a blue thermochromatic ink and the second shape is overprinted with a red thermochromatic ink. As the temperature of the sign increases, the first shape changes from blue to purple and the second shape changes from red to blue. In addition, the background changes from yellow to green as the temperature of the sign increases. Then when the temperature of the sign decreases, the colors revert back to their original color, i.e., the first shape changes from purple to blue, the second shape changes from blue to red, and the background changes from green to yellow.

In an alternative embodiment, a white filtering layer (not shown) is applied directly onto front outlining insulating layer 190. The filtering layer is between approximately 60% to approximately 90% translucent and allows illumination to pass through the filter while the sign is in the "off" state. The white filtering layer provides a white appearance to any graphics underneath the filtering layer. The filtering layer, in one embodiment, is applied using a 305 polyester mesh and screen printing technique and includes about 20% to about 40% Nazdar 3200 UV white ink and about 60% to about 80% Nazdar 3200 mixing clear, which are available from Nazdar, Inc., Kansas City, Mo.

In a further alternative embodiment, after screening background layer 198 onto front surface 162, a UV coating (not shown) is applied to sign 160. Particularly, the UV coating is applied to cover entire front surface 162 of sign 50 and to provide protection to the EL lamp. A protective coating (not shown) is then printed directly over background layer 198. The protective coating protects the integrity and color stability of the inks used in the other layers, especially background layer 198. The protective coating reduces fading of background layer 198 and protects sign 160 from UV radiation. The protective coating is transparent and provides an insu ative property to sign 160 due to the insulative effects of the binder used on the ink.

Similarly, front surface 162 of sign 160 may be coated with a UV coating before applying rear electrode 164 to front surface 162. For example, a UV coating is first applied to front surface 162 to substantially ensure the integrity of the EL lamp layers, e.g., to substantially prevent the plastic substrate from absorbing the screen printable inks.

In a further alternative embodiment, a transparent reflective coating is applied to the protective coating layer. Glass beads or spheres having an optimal index of refraction in the range of 1.9 to 2.1 are mixed with an overprint clear ink. The clear ink may be a UV clear ink available from Nazdar, 8501 Hedge Lane Terrace, Shawnee, Kans. Alternatively, the clear ink may be thermally cured, such as Nazdar 9727 available from Nazdar. The transparent reflective coating allows the color details of the four color background layer to be visible to a person viewing EL sign 160. The transparent reflective coating is reflective to oncoming light, such as car headlights in order to provide greater visibility of the sign at night. Exemplary uses of an EL sign which includes the reflective coating layer are street signs, billboards, and bicycle helmets. In addition, an EL sign utilizing the reflective layer could be used in any application where the sign will be viewed via a light.

In a still further alternative embodiment, the EL sign does not include a decorative background layer. Instead, the protective clear coat is applied directly over the front outlining insulator layer and the transparent reflective coating is applied directly over the protective insulative coat.

In another embodiment, a holographic image (not shown) is formed in place of the four color process used for background layer 198. The holographic image provides the EL sign with the illusion of depth and dimension on a surface that is actually flat. The holographic image, in one embodiment, is applied to the EL sign over the four color process to provide an added dimension to the sign. In an alternative embodiment, the holographic image is applied over the clear coat insulative layer.

After applying rear electrode 164, dielectric layer 172, phosphor layer 174, conductor layer 176, front outlining electrode layer 178, front outlining insulating layer 190, and background layer 198 to sign 160, sign 160 may, for example, be hung in a window, on a wall, or suspended from a ceiling. Power supply 202 is then coupled to front electrode lead 188 and rear electrode lead 168 and a voltage is applied across rear electrode 164 and front electrode 178 to activate phosphor layer 174. Particularly, current is transmitted through front electrode 178 to conductor layer 176, and through rear electrode 164 to illumination area 166 to illuminate the letter "L". EL sign 160 is formed with multiple inks that bond together into a non-monolithic structure. The inks are either heat cured or they are UV cured. In addition, certain layers of EL sign 160 can be heat cured while other layers of the same EL sign 160 can be UV cured.

In accordance with one embodiment, rear electrode 164 is approximately 0.6 millimeters thick, dielectric layer 172 is approximately 1.2 millimeters thick, phosphor layer 174 is approximately 1.6 millimeters thick, conductor layer 176 is approximately 1.6 millimeters thick, front electrode 178 is approximately 0.6 millimeters thick, and background layer 184 is approximately 0.6 millimeters thick. Of course, each of the various thicknesses may vary.

Interconnect tab portion 173 is adjacent sign perimeter 170 and remains uncovered to facilitate attachment of a slide connector 200 and wire harness from a power supply 202 to front electrode lead 188 and rear electrode lead 168. In one embodiment, tab interconnect portion 173 is die cut to provide a mating fit of slide connector 200 onto tab interconnect portion 173. The die cut provides interconnect tab portion 173 with a slot configuration and slide connector 200 includes a pin configuration which ensures that slide connector 200 is properly oriented on tab interconnect portion 173. In one embodiment, slide connector 200 is fixedly attached to interconnect tab portion 173 with screws or other fasteners. Slide connector 200 entirely surrounds exposed leads 168 and 188, i.e., that portion of leads 168 and 188 that have been left uncovered.

In one embodiment, after EL sign 160 has been formed, sign 160 is then vacuum formed as follows. Sign 160, in an exemplary embodiment, includes a clear polycarbonate substrate between about 0.01 and 0.05 inches thick and has a size of about one foot by about one foot to about 10 feet by about 15 feet. Sign 160 also includes an insulative clear coat printed on a back of the substrate, as described above. Sign 160 is then placed in a vacuum form type machine such as a Qvac PC 2430PD, A mandrel mold is fabricated with peaks and valleys and includes draw depths between about 0 inches and about 24 inches. The mold is utilized on products including, but not limited to, helmets, three dimensional advertising signs, ferrings, fenders, backpacks, automobile parts, furniture and sculptures.

Sign 160 is inserted into the vacuum-form machine with the positive image facing up. Sign 160 is then heated for an appropriate time such as about two to about 30 seconds depending upon substrate thickness, i.e., more time is needed for thicker substrates. Once sign 160 is heated for the proper length of time, sign 160 is mechanically pulled down onto the mandrel mold which applies a vacuum pull in two places, a bottom of the vacuum form face, and through openings in the mandrel mold that allow for even pressure pull to sign 160. Sign 160 is then formed in the desired shape of the mandrel mold. Air pressure is then reversed through the openings utilized to create the vacuum which releases sign 160 from the mold.

In a further embodiment, sign 160 is formed on a metal substrate and is embossed so that sign front surface 162 is not planar. Particularly, sign 160 is embossed so that illumination area 166 projects forward with respect to sign outer perimeter 170. In an alternative embodiment, sign 160 is embossed so that one portion of illumination area 166, e.g., the short leg of "L", projects forward with respect to another portion or illumination area 166, e.g., the long leg of "L". In an exemplary embodiment, sign 160 is positioned in a metal press configured to deliver five tons of pressure per square inch to form dimples in sign front surface 162.

The above described EL signs can be utilized in a variety of functions. For example, the signs can be used as a display panel for a vending machine, a display panel for an ice machine, an illuminated panel for a helmet, a road sign, a display panel in games of chance, e.g., slot machines, and as point of purchase signage.

The above described embodiments are exemplary and are not meant to be limiting. The above described method provides for an illuminated sign having an EL lamp that is fabricated directly on the sign, i.e., a prefabricated EL lamp is not coupled to the sign. Such method also facilitates applying each layer of the EL lamp to the EL substrate as a positive image, rather than a reverse image. However, the above described embodiment is exemplary, and is not meant to be limiting.

What is claimed is:

1. A method for forming an illuminated design on a substrate, said method comprising the steps of:

forming a first electrode on the substrate, the first electrode defining a first perimeter;

forming a dielectric layer on the substrate and the first electrode, the dielectric layer extending beyond the first perimeter of the first electrode;

forming a phosphor layer on the dielectric layer, the phosphor layer extending on less than the entire dielectric layer to define an exposed dielectric layer;

forming a sealing layer on at least a portion of said exposed dielectric layer;

forming a conductor layer on the phosphor layer; and forming a second outlining electrode on the sealing layer to transport energy to the conductor layer and phosphor layer.

2. A method in accordance with claim 1 wherein said step of forming a second outlining electrode comprises the step of screen printing a front electrode layer such that a portion of the front electrode layer contacts an outer perimeter of the conductor layer.

3. A method in accordance with claim 1 wherein the substrate is a sign having a front surface, said step of forming the first electrode on the substrate comprises the step of screen printing a rear electrode to the front surface of the sign.

4. A method in accordance with claim 1 wherein said step of forming a phosphor layer comprises the step of screen printing the phosphor layer onto the dielectric layer, the phosphor layer having substantially the same shape and size as the illuminated design.

5. A method in accordance with claim 1 wherein said step of forming a conductor layer over the phosphor layer comprises the step of screen printing a conductive ink over the phosphor layer as a forward image having substantially the same shape and size as the illuminated design.

6. A method in accordance with claim 1 further comprising the step of forming an ultraviolet coating on the substrate so that the ultraviolet coating substantially covers the conductor layer.

7. A method in accordance with claim I further comprising the step of forming an ultraviolet coating on the substrate before forming the rear electrode on the substrate.

8. A method in accordance with claim 1 further comprising the step of printing a background on the substrate.

9. A method in accordance with claim 1 further comprising the step of installing the substrate on a vending machine.

10. A method in accordance with claim 1 further comprising the step of installing the substrate on a bicycle helmet.

11. A method in accordance with claim 1 further comprising the step of installing the substrate on a slot machine.

12. A method in accordance with claim 1 further comprising the step of attaching the substrate to a road sign.

13. The method in accordance with claim 3, wherein the step of screen printing a rear electrode to the front surface of the sign comprises screen printing an ink comprising particles of silver or carbon in a polymer binder.

14. The method in accordance with claim 3, wherein the step of screen printing a rear electrode to the front surface of the sign comprises screen printing an ink comprising particles of silver in a polymer binder.

15. The method in accordance with claim 3, wherein the step of screen printing a rear electrode to the front surface of the sign comprises screen printing an ink comprising particles of carbon in a polymer binder.

* * * * *